US005411017A

United States Patent [19]

Wong

[11] Patent Number: 5,411,017

[45] Date of Patent: May 2, 1995

[54] TWIN COLLAR PROTECTIVE ENCLOSURE

[76] Inventor: Albert H. Wong, 948 Michaeltorena, Los Angeles, Calif. 90026

[21] Appl. No.: 169,584

[22] Filed: Dec. 17, 1993

[51] Int. Cl.[6] ..... A62B 7/10

[52] U.S. Cl. ..... 128/201.25; 128/201.22

[58] Field of Search ..... 2/202, 7; 128/201.22, 128/201.25, 202.18, 202.26, 205.12

[56] References Cited

U.S. PATENT DOCUMENTS

| | | | |
|---|---|---|---|
| 437,995 | 10/1890 | Jensen | 2/202 |
| 1,186,703 | 6/1916 | Sullivan | 2/202 |
| 2,984,839 | 5/1961 | Conrad et al. | 2/7 |
| 3,582,989 | 6/1971 | Fassbender | 2/4 |
| 3,714,670 | 2/1973 | Finsilver et al. | 2/197 |
| 3,747,124 | 7/1973 | Zientara | 2/202 |
| 4,502,157 | 3/1985 | Wong | 2/202 |
| 4,554,683 | 11/1985 | Wong | 2/202 |
| 4,583,535 | 4/1986 | Saffo | 128/201.25 |
| 5,007,115 | 4/1991 | Denbow et al. | 2/202 |
| 5,040,530 | 8/1991 | Bauer et al. | 128/201.25 |
| 5,091,996 | 3/1992 | Kirby | 2/202 |
| 5,146,636 | 9/1992 | De La Pena | 2/202 |
| 5,214,803 | 6/1993 | Shichman | 2/202 |

*Primary Examiner*—Edgar S. Burr
*Assistant Examiner*—Aaron J. Lewis
*Attorney, Agent, or Firm*—Hawes & Fischer

[57] ABSTRACT

A compact and easy-to-use protective enclosure having normally open opposite ends and an identical elastic collar surrounding each end. The enclosure is sized to extend between the head and neck of the wearer and provide a self-contained supply of air from which to breathe when it is desirable to isolate the eyes, nose and ears of the wearer from a hostile environment. The first end of the enclosure is closed against the wearer's neck by the elastic collar surrounding the first end, and the opposite end of the enclosure is closed against the wearer's head by the elastic collar surrounding the opposite end. The first and opposite ends of the enclosure may be tightened around the head and neck of the wearer by pulling on respective attachment straps affixed to the collars so as to correspondingly reduce the areas within such ends. The enclosure is provided with optional filters covered by tear-off strips that may be removed when the enclosure is worn in a non-poisonous environment.

8 Claims, 3 Drawing Sheets

TWIN COLLAR PROTECTIVE ENCLOSURE

BACKGROUND OF THE INVENTION

1. Field of the Invention

This invention relates to a compact and easy-to-use protective enclosure having identical elastic collars located at normally open opposite ends thereof so that the enclosure may be worn from either end by both adults and children. The enclosure is sized to extend between and be reliably secured around the head and neck of a wearer so as to isolate the wearer's nose, eyes and ears from the outside environment while providing a self-contained supply of air from which the wearer can breathe.

2. Background Art

Portable protective enclosures have been used in the past by those who find themselves located within a hazardous or uncomfortable environment containing smoke, dust, skin and eye irritants, insects, and the like. By way of example, reference may be made to my prior U.S. Pat. Nos. 4,502,157 issued Mar. 5, 1985 and 4,554,683 issued Nov. 26, 1985.

However, many of the protective enclosures now available are large and bulky and/or are of complex design. Consequently, it is not always practical for the wearer to carry the protective enclosure with him from place to place. In this case, the wearer may find himself in immediate need but without access to such a protective enclosure. Moreover, different enclosures may be required to fit adults and children. What is more, some enclosures are so large as to obstruct the vision of the wearer or impede his movement in tight quarters. Sometimes, a set of particular operating instructions must be carefully followed to properly use the enclosure. In this case, the wearer may experience difficulty or lose valuable time in activating the assembly, particularly in emergency situations or at locations having little or no light. In fact, the protective enclosure could be rendered substantially useless if not properly fit to the user.

It would therefore be desirable to have available a single, compact and low cost protective enclosure for use by adults and children, alike, that requires no special skill or instructions to operate and may be quickly and easily worn in emergency situations and at locations characterized by low light and little space without hampering the mobility of the wearer.

SUMMARY OF THE INVENTION

A compact, easy-to-use protective enclosure is disclosed which is sized so as to extend between and be reliably secured around the head and neck of a wearer to isolate the eyes, nose and ears of the wearer from environments containing smoke, dust, skin and eye irritants, insects, and the like. The protective enclosure comprises a cylindrical body having normally open ends. An identical elastic collar is affixed to each end of the body for closing the ends against the head and neck of the wearer. An attachment strap is located on each of the collars. One end of each attachment strap is affixed to its collar and the opposite free end has a buttonhole that is spaced from a button attached to the collar. One or more optional filters covered by tear-off strips are located in the sides of the body. The enclosure is formed from a flexible material so that it can be conveniently folded into a compact package and carried near or on the person of the wearer in a handy pouch.

In operation, the protective enclosure is removed from its pouch and unfolded so as to be ready for immediate use. The enclosure has a symmetrical configuration so that either end of the cylindrical body may be the first end to be pulled over the head of the wearer. The first end of the body is pulled downwardly and the elastic collar surrounding the first end closes the enclosure against the neck of the wearer. The second end of the body is then pulled over the wearer's head, and the elastic collar surrounding the second end closes the enclosure against the head. For certain individuals, such as children, it may be necessary to connect the free ends of the attachment straps to be buttons through respective buttonholes. By virtue of the foregoing, the diameters of the elastic collars will be reduced to correspondingly seal the opposite ends of the body of the enclosure against the head and neck of the wearer. When in use, the protective enclosure provides the wearer with a self-contained supply of air from which he can breathe. When the user is located within a non-poisonous environment, the tear-off strips may be removed to activate the filters and permit the wearer to breathe in a normal fashion.

DETAILED DESCRIPTION

Figure 1:
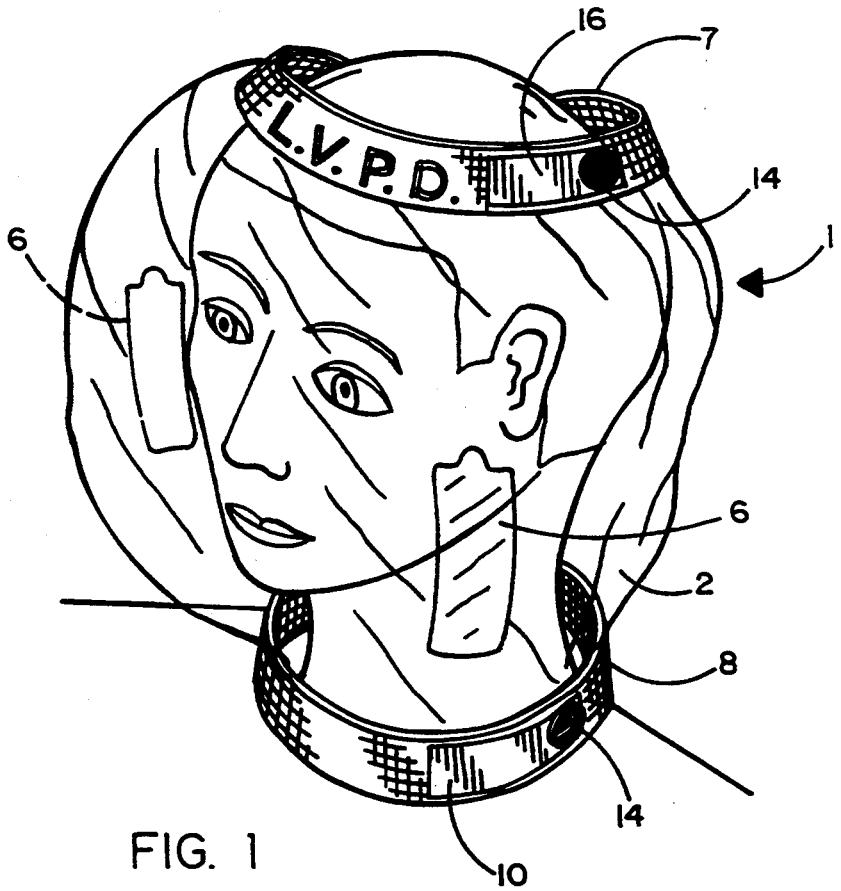
FIGS. 1 and 2 show the protective enclosure of the present invention extending between and secured around the head and neck of a wearer to provide the wearer with a self-contained supply of air from which to breathe.
Figure 2:
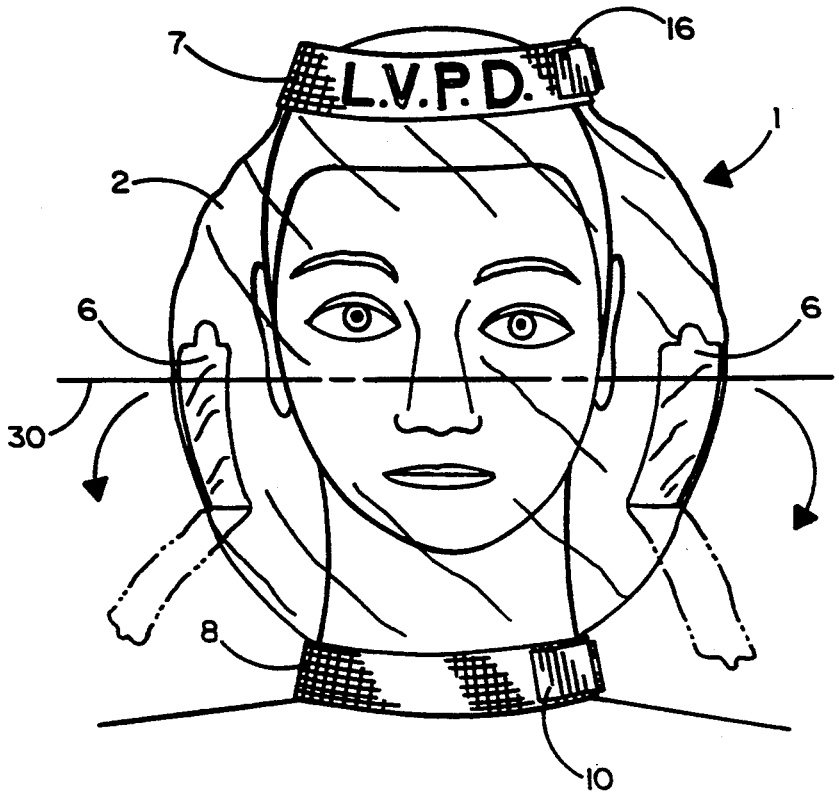

Referring now to the drawings, FIGS. 1 and 2 show the twin collar protective enclosure 1 which forms the present invention being used by a wearer. The protective enclosure 1 has a generally cylindrical body 2 that is open ended and sized to be pulled over and extend between the head and neck of the wearer. The body 2 of enclosure 1 is manufactured from a flexible and transparent material that is impervious to gas and smoke. By way of example, the body 2 of protective enclosure 1 may be formed from a thin plastic material. As will be described in greater detail when referring to FIGS. 4*a* and 4*b*, one or more (e.g. two) optional filters 4 are affixed at opposite sides of the body 2 of the protective enclosure 1. The filters 4 are covered by tear-off strips 6 which may be grasped and removed from the enclosure to permit fluid communication between the wearer and the outside environment.

In accordance with the present improvement, the body 2 of protective enclosure 1 is provided with a pair of collars 7 and 8. A first collar 7 is secured (e.g. sewn) around a first open end of the cylindrical body 2, and the second collar 8 is secured around the opposite open end of cylindrical body 2. The opposing collar 7 and 8 are identical in construction and are preferably formed from an elastic material. As will be described in greater detail when referring hereinafter to FIGS. 6*a* and 6*b*, the protective enclosure 1 includes closure means by which to tighten the collars 7 and 8 and thereby reduce the area of the cylindrical body 2 at the normally open ends thereof so as to enable the enclosure to be releaseably and reliably secured around the head and neck of the wearer.

In this regard, it is to be recognized that the protective enclosure 1 has a symmetrical shape with regard to a reference line (designated 30 in FIG. 2) running perpendicular to the longitudinal axis of the cylindrical body 2 mid-way between the collars 7 and 8. That is to say, either one of the open ends of the body 2 can be the first end to be pulled over the wearer's head. Therefore, in emergency and low light situations, the enclosure 1 may be quickly and conveniently removed from its folded, packaged configuration (of FIG. 5) and unfolded to its ready-to-use configuration as shown in FIGS. 1 and 2. Moreover, and as a particular advantage of the present invention, each of the collars 7 and 8 surrounding the open ends of the body 2 of enclosure 1 performs an important function, regardless of which end is the first to be pulled over the head of the wearer.

More particularly, the elastic collar (e.g. 8) at the normally open leading end of the body 2 of protective enclosure 1 of FIGS. 1 and 2 is pulled completely over and downwardly from the wearer's head so as to close the leading end around the wearer's neck. The elastic collar (e.g. 7) at the normally open trailing end of the body 2 of enclosure 1 is pulled partially over the wearer's head so as to close the trailing end around the top of the head. It is to be understood that the aforementioned references to leading and trailing ends of the body 2 of protective enclosure 1 are for purpose of example only and, because of its symmetrical shape, either end of enclosure 1 may be regarded as the leading end.

Figure 6A:
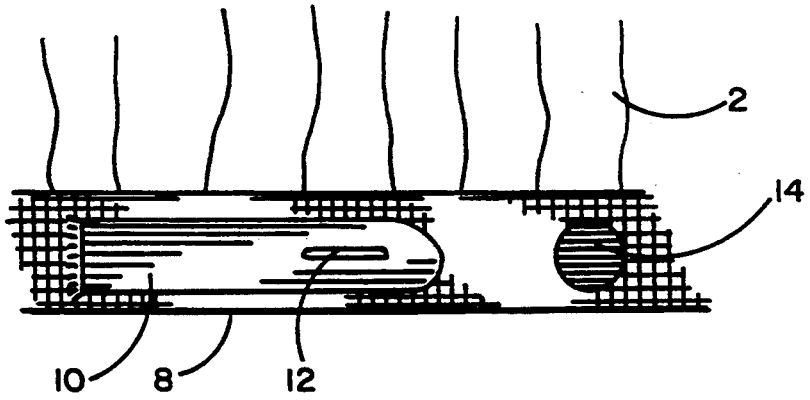
FIG. 6*a* shows an attachment strap located at a first end of the protective enclosure and spaced from a button.
Figure 6B:
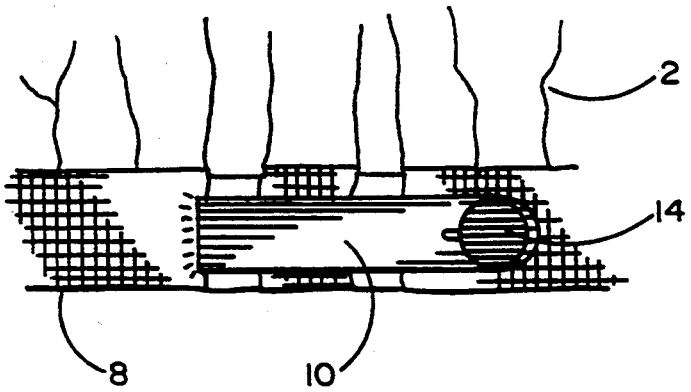
FIG. 6*b* shows the attachment strap of FIG. 6*a* pulled towards and connected to the button to secure the first end of the protective enclosure against the neck of the wearer.

The closure means by which the elastic collar 7 and 8 at the opposite ends of the body 2 of protective enclosure 1 are tightened to form air-tight seals with the head and neck, respectively, are now described while referring to FIGS. 6*a* and 6*b* of the drawings. Being that each of the elastic collars 7 and 8 is identical, the closure means associated with only one of the collars (e.g. 8) will be described.

As is best shown in FIG. 6*a*, an attachment strap 10 extends circumferentially around a portion of the collar 8. One end of the attachment strap 10 is sewn to the collar 8 and a buttonhole is formed through the opposite free end. A button 14 is sewn to the collar 8 so as to be spaced a short distance from the buttonhole 12 through the attachment strap 8. Although a single button 14 is illustrated, it is within the scope of this invention to have a series of buttons arranged in spaced alignment with one another along the collar 8.

With the button 14 spaced from the buttonhole 12 in the free end of the attachment strap 10, as shown in FIG. 8*a*, the elastic collar 8 will have a relatively large diameter and the leading end of the body 2 surrounded by collar 8 will define a relatively large area. In this case, the collar 8 may fit loosely around the neck of the wearer. Similarly, with the button 14 spaced from the buttonhole 12 of attachment strap 16, not shown, the opposite elastic collar 7 will also have a relatively large diameter, and the trailing end of the body 2 surrounded by collar 7 will define a relatively large area. Accordingly, the collar 7 will fit loosely around the head of the wearer.

In FIG. 6*b*, the free end of the attachment strap 10 is pulled towards the button 14 of collar 8, and the button 14 is received through the buttonhole 12. With the free end of the attachment strap 10 pulled towards and then connected to the button 14, as just described, the elastic collar 8 is correspondingly stretched so that the diameter of the collar surrounding the leading end of the body 2 of protective enclosure 1 will be decreased. Accordingly, and as is best shown in FIGS. 1 and 2, the collar 8 will fit snugly around the neck of the wearer to form an air-tight seal thereagainst. Similarly, the diameter of the elastic collar 7 surrounding the trailing end of the body 2 of enclosure 1 will also be reduced, whereby the collar 7 will fit snugly around and form an air-tight seal against the head of the wearer.

What is more, the collar 7 at the trailing end of the body 2 will apply a sufficient holding force to prevent the protective enclosure 1 from inadvertently sliding off the head of the wearer and breaking the air-tight seal therearound, whereby to avoid subjecting the wearer to possible asphyxiation as might otherwise occur if the seal were broken and the wearer were exposed to a poisonous environment. That is, with the protective enclosure 1 extending between and attached to form air-tight seals with the head and neck of the wearer, a self-contained supply of breathable air will be trapped within the body 2 to provide the wearer with additional time (e.g. from three to five minutes) that can be used to escape the poisonous environment in which he might be trapped.

It may be appreciated that for certain individuals, particularly adults, pulling the attachment straps 10 and 16 into contact with buttons 14 on respective collars 8 and 7 may not be required to form air-tight seals between the protective enclosure 1 and the wearer. That is to say, the elastic collars 7 and 8 may be sufficient in their normally relaxed state to removably and reliably secure the enclosure 1 around the neck and head of the wearer. However, for other individuals, such as children, use of the attachment straps 10 and 16 may be necessary to stretch the collars 7 and 8 and thereby close the opposing ends of the body 2 of enclosure 1 so as to properly seal the enclosure against the wearer.

Figure 3:
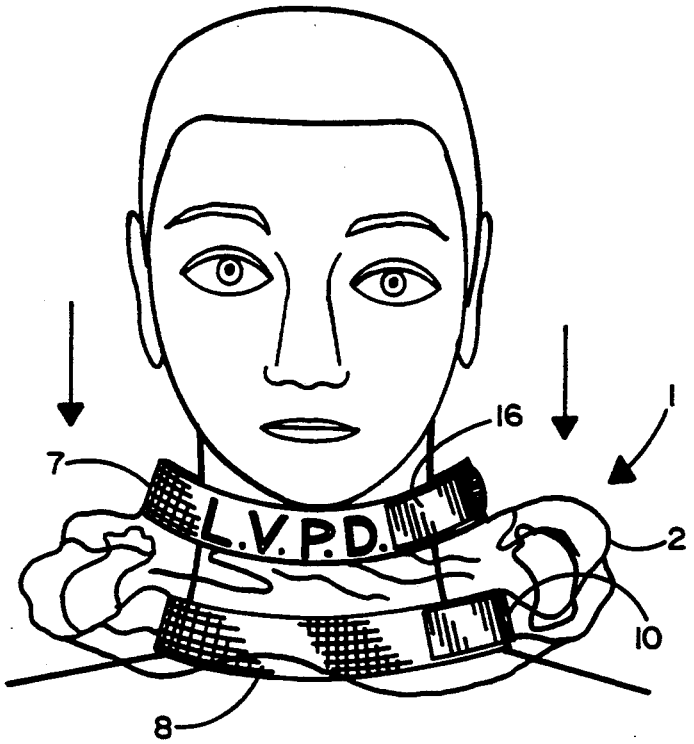
FIG. 3 shows the protective enclosure of FIGS. 1 and 2 pulled downwardly when not in use so as to fit around the neck of the wearer.

During times of non-use or after the wearer has escaped from a hazardous environment, it may be desirable to open the protective enclosure 1 without removing the enclosure from the wearer. In this case, and as is best shown in FIG. 3 of the drawings, the wearer simply grasps and expands the collar 7 at the trailing end of the body 2 and then collapses the enclosure downwardly and in the direction represented by the reference arrows. The collapsed enclosure 1 will then rest around the neck of the wearer without obstructing his vision or movement. More importantly, the protective enclosure 1 is readily accessible so as to be quickly and easily pulled upwardly and returned to the in-use position of FIGS. 1 and 2 with a fresh supply of air trapped therewithin.

Figure 4A:
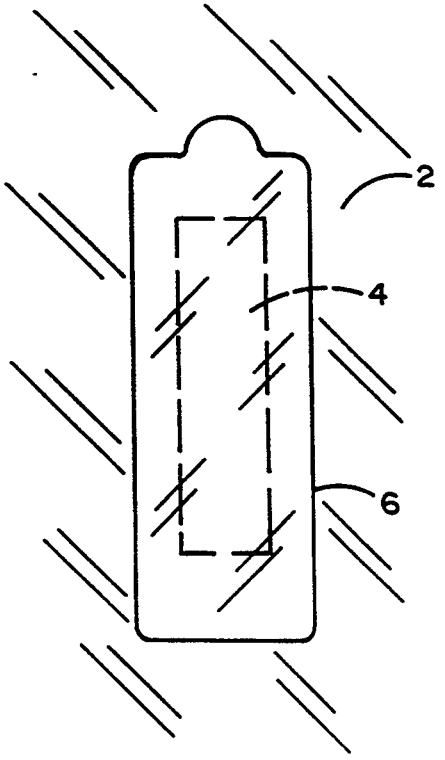
FIG. 4*a* shows an optional filter located in one side of the protective enclosure and covered by a tear-off strip.
Figure 4B:
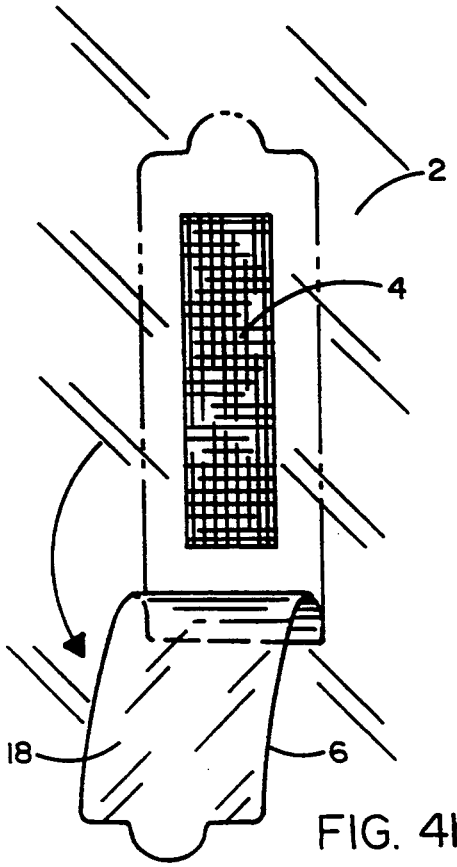
FIG. 4*b* shows the tear-off strip removed from the filter of FIG. 4*a*.

Referring now to FIGS. 4*a* and 4*b* of the drawings, the optional filters 4 are described. As previously indicated, a pair of filters may be affixed (e.g. heat sealed) in opposite sides of the body 2 of protective enclosure 1. The filters 4 include a conventional filter material that is capable of blocking the transmission of dust, odors, pollen, insects, and the like. Each filter 4 is covered by a respective tear-off strip 6. The tear-off strips 6 are provided with an adhesive backing 18 to permit the strips to be removably attached to the filters 4. In the event that the protective enclosure is being worn in a non-poisonous environment, the wearer may wish to breathe the air that is external to the protective enclosure 1, while protecting his head and face from exposure to the outside environment. Accordingly, the wearer simply pulls the strips 6 off the body 2 of enclosure 1 so that the filters 4 communicate with the environment. The wearer can then breathe in the normal fashion.

Figure 5:
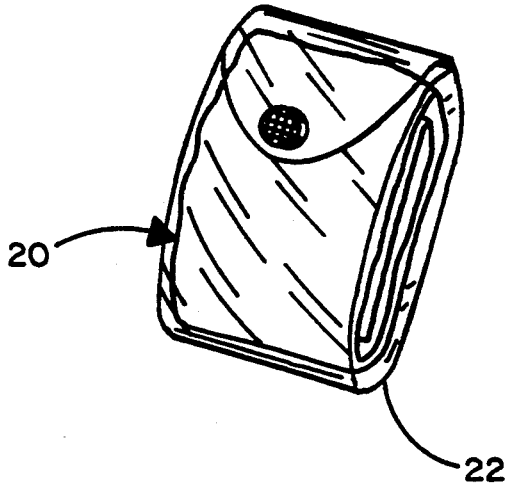
FIG. 5 shows the protective enclosure folded into a compact package and stored in a convenient carrying pouch.

Because of the flexible nature of the body 2 of protective enclosure 1, the enclosure may be conveniently folded into a compact package 20, like that shown in FIG. 5 of the drawings. The folded package 20 is suitable to be placed inside a small pouch 22 for convenient storage and transport. In this regard, the pouch 22 can be advantageously carried in a purse, a suitcase, a briefcase, or even a coat pocket so that the wearer will have ready access to the protective enclosure 1 of this invention should the need arise. Once removed from its pouch 22, the folded package 20 may be quickly unfolded and worn in the matter of a few moments so as to isolate the wearer's head and face from the outside environment.

A low cost, easy to use protective enclosure 1 has been disclosed having a pair of identical elastic collars 7 and 8 surrounding normally open opposite ends which permit the enclosure to be worn from either end while eliminating installation errors in emergency situations. The protective enclosure 1 herein disclosed may be used by both private individuals and government officials (e.g. police and fire officials) to protect the eyes, ears and nose of the wearer in hostile environments filled with smoke, dust, noxious odors, insects, skin and eye irritants, or the like. Moreover, because of the ability to adjust the size of the open ends of the protective enclosure 1 to correspond with the size of the head and neck of the wearer, a single enclosure is suitable to fit all wearers. What is more, the protective enclosure 1 may be conveniently folded into a compact package so as to be unobtrusively carried by the wearer without interfering with his activities.

It will be apparent that while a preferred embodiment of the invention has been shown and described, various modifications and changes may be made without departing from the true spirit and scope of the invention.

Having thus set forth a preferred embodiment, what is claimed is:

1. A protective enclosure to be worn over the face of a wearer to provide a self-contained supply of air from which the wearer can breathe, said enclosure comprising a flexible, gas and smoke impervious body having first and opposite normally open ends, the first open end of said body sized to surround the wearer's head and the opposite open end of said body sized to surround the wearer's neck, a first elastic collar extending around said first end to close said first end and form an air-tight seal against the wearer's head to prevent fluid communication via said first end between the supply of air within said enclosure and the atmosphere outside said enclosure, and a second elastic collar extending around said opposite end to close said opposite end and form an air-tight seal against the wearer's neck to prevent fluid communication via said opposite end between the supply of air within said enclosure and the atmosphere outside said enclosure, said enclosure preventing said outside atmosphere from reaching the eyes, nose and ears of the wearer.

2. The protective enclosure recited in claim 1, further comprising closure means by which to tighten said first and opposite ends of said body around the head and neck of the wearer.

3. The protective enclosure recited in claim 2, wherein said closure means includes first and second straps, each strap having a first end affixed to one of said first or second collars and a second free end, and means for connecting said free ends of said straps to respective ones of said collars to which said first ends of said straps are affixed for reducing the area within said first and opposite ends of said body surrounded by said first and second collars.

4. The protective enclosure recited in claim 3, further comprising a buttonhole formed through each of said free ends of said first and second straps and a button affixed to each of said first and second collars in spaced alignment with said buttonholes, said free ends of said straps pulled towards and connected to said buttons via said buttonholes to reduce the area within said first and opposite ends of said body.

5. The protective enclosure recited in claim 1, further comprising at least one filter located in said body to permit fluid communication between the wearer and the environment outside the enclosure.

6. The protective enclosure recited in claim 5, wherein said filter is covered by a removable strip adapted to block communication between the wearer and said outside environment.

7. The protective enclosure recited in claim 1, wherein said enclosure has a symmetrical shape with respect to a reference line running perpendicular to the longitudinal axis of said body mid-way between said first and opposite ends thereof, such that said body extends between the head and neck of the wearer with said first elastic collar sealing the first end of said body against the wearer's head and said second elastic collar sealing the opposite end of said body against the wearer's neck, and said first elastic collar sealing the first end of said body against the wearer's neck and said second elastic collar sealing the opposite end of said body against the wearer's head.

8. The protective enclosure recited in claim 1, further comprising means attached to each of said first and second elastic collars to reduce the size of the first and opposite ends of said body and thereby tighten said first and opposite ends around the head and neck of the wearer.

* * * * *